US006398336B1

(12) United States Patent
Yoda et al.

(10) Patent No.: US 6,398,336 B1
(45) Date of Patent: Jun. 4, 2002

(54) INK JET RECORDING APPARATUS AND MAINTENANCE METHOD THEREFOR

(75) Inventors: Satoshi Yoda, Okaya; Yukihiro Hanaoka, Narakawa-mura, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/356,100

(22) Filed: Jul. 15, 1999

(30) Foreign Application Priority Data

Jul. 15, 1998 (JP) ..... 10-201012

(51) Int. Cl.[7] ..... B41J 2/165

(52) U.S. Cl. ..... 347/23; 347/29; 347/33

(58) Field of Search ..... 347/14, 23, 29, 347/33, 35

(56) References Cited

U.S. PATENT DOCUMENTS

| | | | | | |
|---|---|---|---|---|---|
| 5,341,163 | A | * | 8/1994 | Hanabusa | 347/23 |
| 5,475,404 | A | * | 12/1995 | Takahashi et al. | 347/23 |
| 5,793,388 | A | * | 8/1998 | Martinson et al. | 347/19 |
| 6,042,214 | A | * | 3/2000 | Minowa et al. | 347/23 |

FOREIGN PATENT DOCUMENTS

| | | | | |
|---|---|---|---|---|
| EP | 0 442 438 | | 8/1991 | |
| EP | 0 442 711 | | 8/1991 | |
| EP | 0 589 581 | | 3/1994 | |
| EP | 0 694 404 | A2 * | 1/1996 | 347/23 |
| EP | 0 803 359 | | 10/1997 | |
| JP | 02-092548 | | 4/1990 | |
| JP | 03-293154 | | 12/1991 | |
| JP | 04-255361 | | 9/1992 | |

* cited by examiner

*Primary Examiner*—John Barlow
*Assistant Examiner*—Shih-wen Hsieh
(74) *Attorney, Agent, or Firm*—Michael T. Gabrik

(57) ABSTRACT

In an ink jet recording apparatus, when the time since a last head maintenance process was executed exceeds a second period of time but is less than a first period of time, the printing status of the apparatus is monitored. During this time frame, a non-print period is measured and if that period exceeds a third period of time, a head maintenance drive controller causes another head maintenance process to be executed. However, when the time since the last head maintenance process was executed exceeds the first period of time, the head maintenance process is executed without regard to the printing status. Alternatively, the execution of the head maintenance process can be based on a print amount, such as the number of lines printed, since the last head maintenance process was executed. In this case, when the number of lines printed since the last head maintenance process was performed exceeds a second number of lines but is less than a first number of lines, the printing status is monitored. During this period, a head maintenance process will only be executed if the non-print period exceeds the third period of time. However, when the print amount exceeds the first number of lines, the head maintenance process is executed without regard to the printing status. The head maintenance process includes drawing a predetermined amount of ink from the nozzles of the recording head using an ink suction mechanism and/or wiping ink from the nozzle forming surface of the recording head. With these arrangements, an ink jet recording apparatus is provided in which head maintenance is accomplished on a regular basis while minimizing disruptions to the printing process.

27 Claims, 7 Drawing Sheets

INK JET RECORDING APPARATUS AND MAINTENANCE METHOD THEREFOR

BACKGROUND OF THE INVENTION

1. Field of the Invention

The present invention relates to an ink jet recording apparatus having a maintenance unit, i.e. a mechanism that performs a maintenance process on a recording head in the apparatus for maintaining the printing performance of the recording head. The present invention also relates to a head maintenance method, a software program for implementing the head maintenance method, and media on which the program is recorded or carried.

2. Description of the Related Art

Ink jet recording apparatuses such as printers are equipped with an ink supply source in the form of an ink cartridge or the like, a recording head having a plurality of nozzles, and an ink supply passage extending between the ink supply source and the recording head nozzles. Printing is executed by drawing ink from the supply source through the supply passage and ejecting ink droplets from the nozzles onto a recording sheet.

Although this arrangement generally works quite well to produce high quality printed output, certain problems tend to arise after an extended period of printer nonuse. When a substantial period of time elapses during which no ink is ejected from the nozzles, water evaporates from the nozzles thereby increasing the viscosity of the remaining ink, or bubbles enter the recording head through the nozzle. To cope with these problems, an ink suction mechanism is sometimes provided to perform a head maintenance operation which involves drawing ink from the nozzles and discharging it to the outside. By periodically performing such a head maintenance operation, the recording head can be maintained in a state in which it can execute proper printing.

Some ink jet recording apparatuses are also provided with a wiping mechanism to perform a different type of head maintenance operation. The wiping mechanism employs an elastic adsorbing mechanism to wipe away foreign matter such as paper dust, ink and the like which have adhered to the surface on which the nozzles are formed. The foreign matter has access to the nozzle forming surface by way of a small gap between the nozzle forming surface and the recording sheet. When such foreign matter adheres to the nozzle forming surface, the nozzles become clogged or the recording sheet may get stained by the ink build up on the nozzles. By periodically carrying out this type of head maintenance operation, the recording head can be maintained in a state in which it can execute proper printing. Note that the maintenance operation used in this specification may be also referred to as a head recovery operation or head cleaning operation among the skilled persons. Hereinafter an operation such as an ink sucking process executed by the ink suction mechanism and a wiping process executed by a wiping mechanism may be referred to as a cleaning operation.

An ink jet recording apparatus provided with an ink suction means and a wiping means arranged as described above is disclosed in, for example, Japanese Unexamined Patent Publication No. 4-255361. Furthermore, an ink jet recording apparatus for restoring a recording head periodically after a predetermined period of time is disclosed in, for example, Japanese Unexamined Patent Publication No. 2-92548.

Conventionally, the head maintenance processing is carried out each time the predetermined period of time elapses or each time a predetermined amount of printing is completed. In either case, the head maintenance process is carried out during a time when no printing operation is being performed because a print operation cannot be interrupted for the execution of the head maintenance process.

In the situation when the predetermined period of time elapses or when the predetermined amount of printing is completed just before printing is started, the head maintenance processing is carried out prior to the start of print operation. In this case, even though a print command may have been issued, the print operation is not carried out until after the head maintenance process is completed. This has the undesirable effect of increasing the time between the issuance of a print command and the actual execution of the print operation.

Similarly, if the head maintenance processing is triggered at a time during which the printer is executing one of a series of successive print operations, the printer will complete the present printing operation, after which the head maintenance process will be executed. After the head maintenance process is completed, the next printing operation will be started. Thus, there is a period of printing "down time" between the completion of one print operation and the start of another while head maintenance processing is executed. This is also undesirable in that it increases the overall time it takes to complete the series of print operations.

Thus, when head maintenance processing is carried out in the conventional manner, there is some chance that head maintenance may be triggered at an inconvenient time such as between the issuance of a print command and the completion of a print operation or during the execution of a series of print operations which are to be successively carried out at small intervals. When either of these situations occurs, completion of the printing operation or series of printing operations will be undesirably delayed.

OBJECTS OF THE INVENTION

Therefore, it is an object of the present invention to overcome the aforementioned problems.

In view of the above-noted problems, another object of the present invention is to provide an ink jet recording apparatus which reliably executes a head maintenance process to maintain the quality of the print operation while minimizing the disruption such maintenance operation may have on the printing process or those using the recording apparatus.

A further object of the invention is to provide a method for performing the head maintenance process of the present invention.

Still another object of the invention is to provide a program of instructions (i.e., software) for implementing the head maintenance process method of the present invention, and media on which the program is recorded or carried.

SUMMARY OF THE INVENTION

According to one aspect of the present invention, an ink jet recording apparatus is provided that includes a recording head having at least one nozzle through which ink droplets are ejected, and a maintenance unit for executing or performing a maintenance operation on the recording head under the direction of a head maintenance drive controller. The ink jet recording apparatus comprises at least one counting device, such as a timer and/or counter, that counts at least one physical quantity, such as elapsed time and/or an amount of print since a last maintenance operation was performed, to obtain at least one magnitude (i.e., the elapsed time and/or the amount of print value) indicative of a degree of operativeness of the recording head, and also counts a non-print period of time during which no printing operation is performed by the recording head and compares the non-print period of time with a reference period of time. The degree of operativeness represents the degree of necessity to recover or clean the recording head. In accordance with this aspect of the invention, the controller controls the maintenance unit in response to the counting device(s) such that the maintenance unit performs a new maintenance operation when either of the following conditions is met:

(a) the at least one magnitude exceeds a first value; or (b) the at least one magnitude exceeds a second value but does not exceed the first value and the non-print period of time is greater than the reference period of time.

According to another aspect of the invention, the ink jet recording apparatus comprises a timer that measures the elapsed time since the last the head maintenance process was performed and compares the elapsed time with a first period of time and a second period of time which is less than the first period of time. When the elapsed-time is greater than the second period of time, the same timer or a different timer measures a non-print period of time during which no printing is performed by the recording head and compares the non-print period of time with a third period of time. The head maintenance drive controller controls the execution of the head maintenance process carried out by the maintenance unit in accordance with the outputs from the timer(s) when either of the following conditions are satisfied:

Condition 1: The non-print period of time is greater than the third period of time and the elapsed time is greater than the second period of time but less than the first period of time; or Condition 2: The elapsed time exceeds the first period of time. Under this condition, the non-print period of time is not used.

Thus, in the ink jet recording apparatus of the present invention arranged as described above, consideration is given to executing the head maintenance process from the end of the second period of time until the first period of time at which time the execution of the head maintenance processing is required. Between the second and first periods of time, the head maintenance process is executed when the non-print period of time exceeds the third period of time. In other words, in the present invention, there is provided a time frame (between the second and first periods of time) during which printing is carried out in preference to the head maintenance process. During this time frame the head maintenance process will only be performed if no printing occurs and no print command is issued for the third period of time. If no such activity occurs during that third period of time within the above-mentioned time frame, it is assumed that the apparatus is not currently being used and executes the head maintenance process. However, once the elapsed time exceeds the first period of time the head maintenance process is executed immediately after any print operation currently being performed is completed. After the execution of each head maintenance operation, the control sequence is reset to begin the measuring and comparing process again.

By providing a time frame in which to execute the head maintenance process without disrupting the printing process, the ink jet recording apparatus of the present invention eliminates or at least minimizes any interruptions to the printing process in order to accommodate the head maintenance process. The first period of time represents the time at which the head maintenance process must be performed and is generally determined by the type and model of the apparatus being used. However, the second and third periods of time may be set in accordance with the manner-in which the apparatus is used.

Control of the head maintenance process may also be based on the amount of print generated by the recording head since the last head maintenance process was performed. The amount of print generated may be quantified by the number of lines printed and may be used instead of, or in addition to, the elapsed time measurement. In either case, the ink jet recording apparatus includes a counter that counts the number of lines printed by the recording head since the recording head was last subjected to the head maintenance process and compares that count with a first print amount (i.e., a first predetermined number of lines) and a second print amount (i.e., a second predetermined number of lines) which is less than the first print amount. A timer measures a non-print period of time during which no printing is executed by the recording head and compares the non-print period of time with the third period of time. The head maintenance drive controller directs the execution of the head maintenance process which is carried out by the maintenance unit in accordance with the outputs from the counter and the timer when either of the following conditions are satisfied:

Condition 3: The non-print period of time is greater than the third period of time and the amount of print is greater than the second print amount but less than the first print amount; or Condition 4: The amount of print exceeds the first print amount. Under this condition, the non-print period of time is not used.

Controlling the head maintenance process based on the amount of print generated since the last head maintenance process also overcomes the disadvantage in conventional systems of prolonging a series of successive print operations while the head maintenance process is executed.

The maintenance unit may comprise a pump for forcibly drawing ink from the nozzles of the recording head and discharging it to the outside. Alternatively or in addition to the pump, the maintenance unit may comprise a head wiping mechanism which may include a blade for wiping away foreign matter adhered to the nozzle forming surface of the recording head.

Methods for maintaining an ink jet recording apparatus and in particular for controlling the execution of the head maintenance process are also provided in accordance with the above-described control schemes. Such methods may be implemented by a program of instructions (i.e., software) which may be embodied on a device-readable medium.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

DESCRIPTION OF THE PREFERRED EMBODIMENTS

An ink jet recording apparatus of the present invention will be described below with reference to the accompanying drawings.

Overall Arrangement

Figure 1:
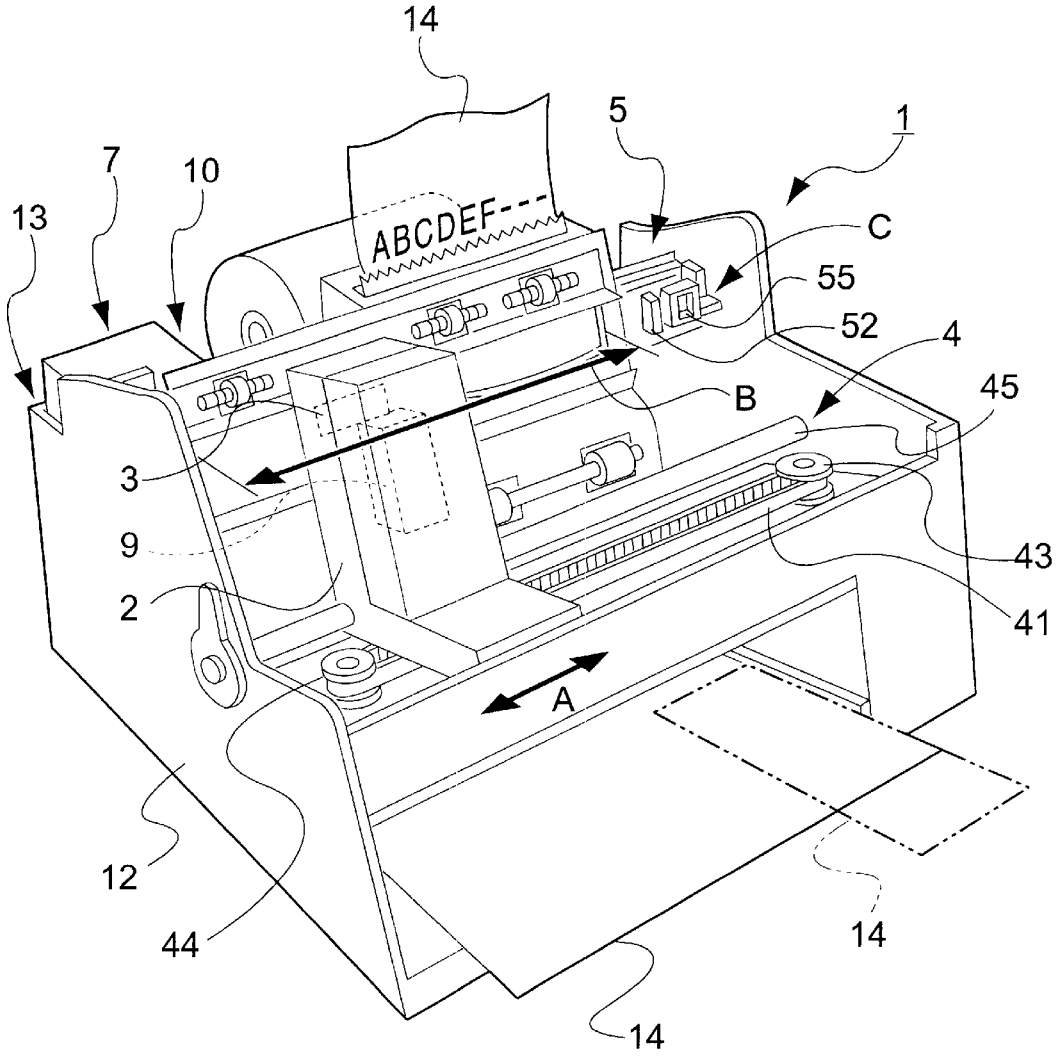
FIG. 1 is a perspective view showing an ink jet recording apparatus to which the present invention is applied.
Figure 2:
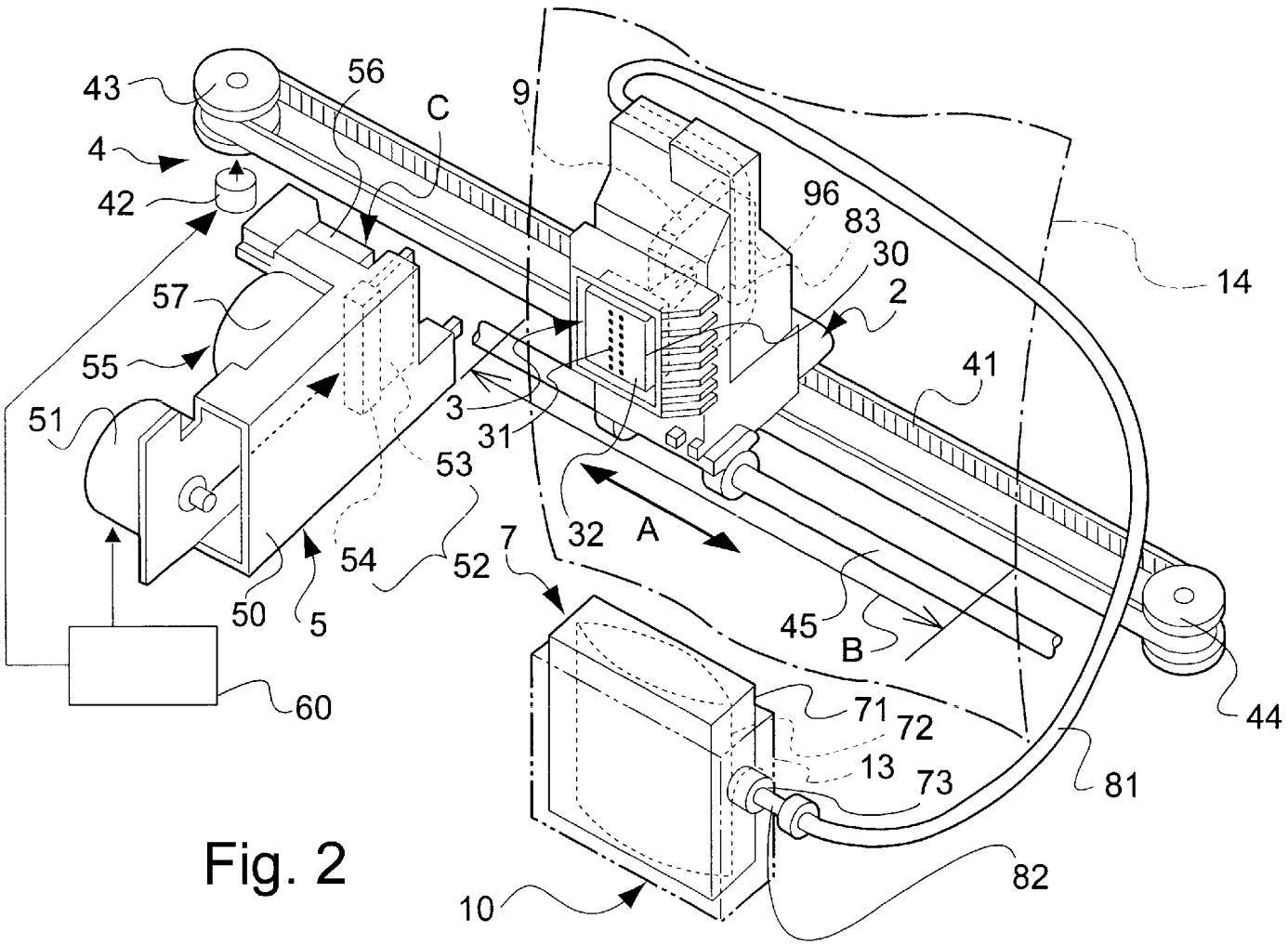
FIG. 2 is a perspective view showing the main portion of the apparatus shown in FIG. 1.

FIG. 1 is a front perspective view of the ink jet recording apparatus to which the present invention is applied, and FIG. 2 is a rear perspective view of the main portion of the ink jet recording apparatus shown in FIG. 1.

As shown in the drawings, the ink jet recording apparatus 1 comprises a recording head 3 for ejecting ink droplets, a carriage 2 on which the recording head 3 is mounted, a moving mechanism 4 for moving the carriage 2 in a scan direction shown by an arrow A, and an ink supply mechanism 10 for supplying ink to the recording head 3.

The recording head 3 includes a rectangular nozzle forming surface 32 on which a plurality of nozzles 31 are formed to eject ink. The nozzle forming surface 32 is an exposed surface on a rectangular piece 30 formed to the carriage 2.

As shown in FIG. 2, the moving mechanism 4 for moving the carriage 2 comprises a guide shaft 45, a timing belt 41 stretched between a drive-side pulley 43 and a follower-side pulley 44, and a carriage motor 42 for rotating the drive side pulley 43. The lower surface portion of the carriage 2 is slidably supported on the guide shaft 45 and coupled to the timing belt 41. Thus, when the timing belt 41 is moved by the carriage motor 42, the carriage 2 is moved in the scanning direction A along the guide shaft 45.

A recording sheet 14 is inserted into an opening in the recording apparatus 1 and is transported along an internal path (not shown) to a point where a portion of the recording sheet 14 faces the nozzle forming surface 32. Ink supplied from the ink supply mechanism 10 is ejected as ink droplets from the nozzles 31 onto the recording sheet 14 as the carriage 2 moves in the scanning direction A to execute a printing operation.

The ink supply mechanism 10 comprises an ink cartridge 7 detachably mounted on an ink cartridge mounting section 13 which is formed on the main body 12 of the ink jet recording apparatus 1, a pressure damper 9 mounted on the carriage 2, and an ink supply pipe 8 connected between the ink cartridge 7 and the pressure damper 9.

A head maintenance unit 5 is affixed to one side of the main body 12 where it engages the carriage 2 when the carriage 2 is in its home position, shown by an arrow C. The head maintenance unit 5 includes a head wiping mechanism 52 and an ink suction mechanism 55 as a head maintenance mechanism for executing the head maintenance process on the recording head 3.

The ink cartridge 7 is formed with a flexible ink bag 72 contained in a rigid case 71. An ink-supply needle 82, fitted to one end portion of an ink supply tube 81, is connected to an ink take out port 73 formed in the ink bag 72. The other end portion 83 of the ink supply tube 81 is connected to the pressure damper 9. Further, a leading end portion of an ink outlet path 96 formed in the pressure damper 9 is connected to the recording head 3.

Consequently, the ink stored in the ink bag 72 of the ink cartridge 7 is supplied via the ink supply tube 81 to the pressure damper 9 before being sent to the recording head 3. Then the ink supplied to the recording head 3 is ejected from the ink nozzles 31.

Ink Suction Mechanism

The ink suction mechanism 55 includes a cap 56 for covering the nozzle forming surface 32 of the recording head 3 when the carriage 2 and recording head 3 are moved to the home position C. The cap 56 is in a recessed position within a unit case 50 when the carriage 2 is moved within a recording region B. When the carriage 2 is moved to the home position C, the position of the cap 56 is switched to a position projecting forward from the unit case 50 to cover the nozzle forming surface 32 of the recording head 3.

A pump 57 which is driven by a motor 51 mounted on the unit case 50 is used to reduce pressure in the cap 56. By operating the pump 57 when the nozzle forming surface 32 is covered with the cap 56, the ink suction process, which draws ink from the nozzles 31 and discharges it to the outside, can be carried out to effectively remove bubbles and ink having increased viscosity from the recording head 3. Thus, with the execution of this process, the ink in the recording head 3 can be restored to its proper state.

Head Wiping Mechanism

As shown in FIG. 2, the head wiping mechanism 52 includes an elastically deformable blade 53 and a blade holding member 54 which holds the blade 53. The blade holding member 54 is moved reciprocally in a direction generally perpendicular to the movement of the carriage 2 by a motor 51 mounted on the unit case 50 through a transmission mechanism such as a gear train or the like (not shown) disposed in the unit case 50. In operation, the motor 51 moves the blade holding member 54 and blade 53 between a position in which the blade 53 is withdrawn in the unit case 50 and a position in which the blade 53 is projected from the unit case 50. When the blade 53 is in the projected position, the extreme end of the blade 53 comes into contact with the nozzle forming surface 32 when the carriage 2 is moved from the print region B to the home position C, whereby ink, paper dust, and the like adhered to the nozzle forming surface 32 are wiped away.

Drive Control System

In the ink jet recording apparatus 1, the operation of carriage motor 42, recording head 3, and recording sheet transport mechanism 65, as well as the operation of the ink suction mechanism 55 and the head wiping mechanism 52 are mainly controlled by a drive controller 60 which has a microcomputer (CPU) embodied therein. The drive controller 60 controls the drive of these components under the control of the CPU. In one embodiment of the invention, a control program of instructions (i.e., software) stored in a microprocessor readable medium such as a ROM is copied into a working memory such as a RAM and executed by the CPU to implement the control method of the subject invention.

More broadly, a program of instructions for implementing the head maintenance process of the present invention may be conveyed by a variety of processor or device readable mediums including magnetic tape, magnetic disk, optical disc, or carrier waves such as baseband or modulated communication paths throughout the spectrum including from supersonic to ultraviolet frequencies. When embodied in one of these mediums the program code may be copied into RAM for execution by the CPU.

Figure 3:
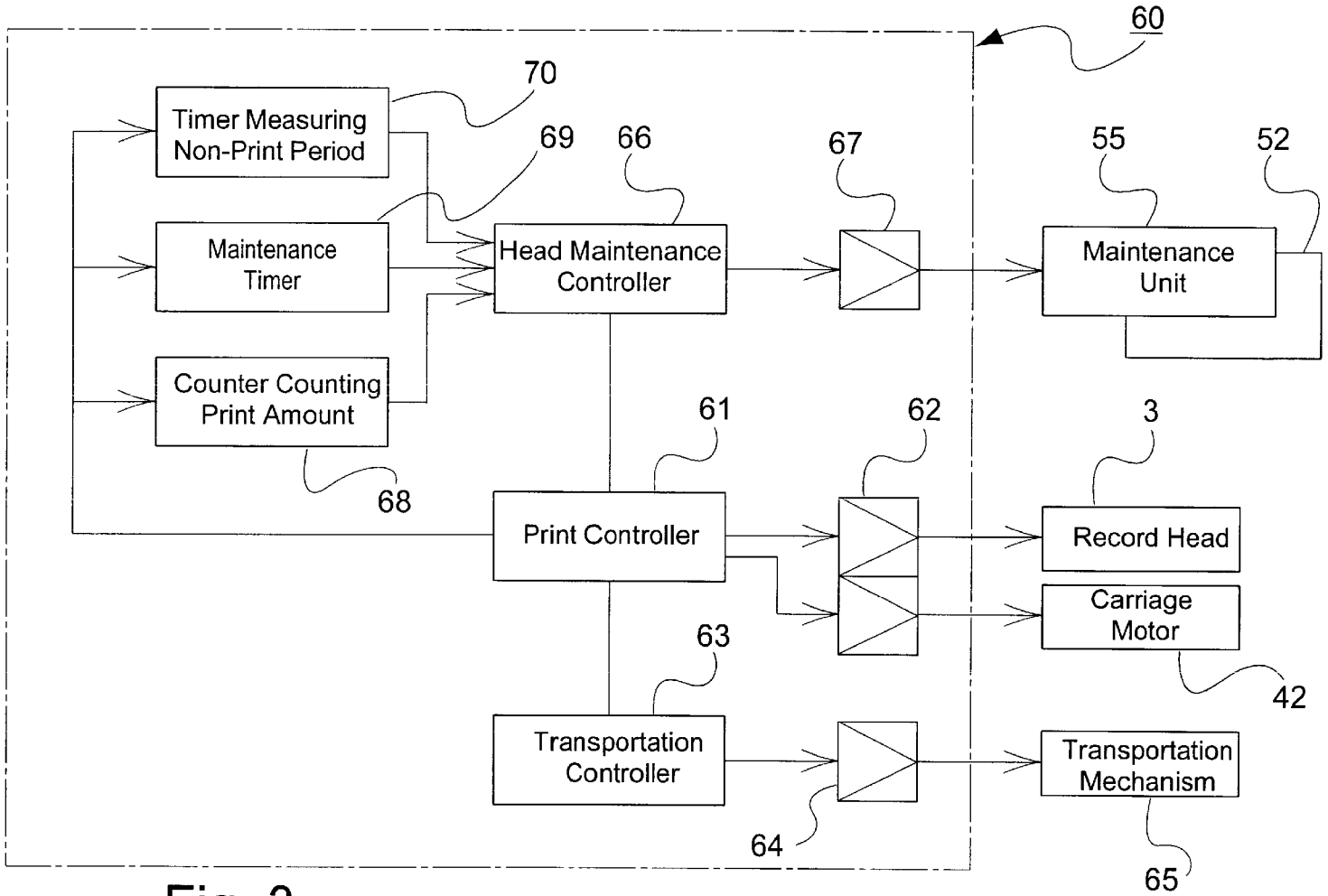
FIG. 3 is a functional block diagram showing a function realized by the drive control system of the ink jet recording apparatus shown in FIG. 1 in block units.

FIG. 3 shows a block diagram of the drive controller 60 and its components and the functional relationships between these components and the controlled elements of the maintenance unit 5 (namely, the ink suction mechanism 55 and the head wiping mechanism 52) which are used to restore the recording head or to maintain the printing performance of the recording head.

Unless otherwise specified, the head maintenance process in the illustrated embodiments may include the ink suction operation only, the head wiping operation only, or both. The ink suction operation is executed by the ink suction mechanism 55 to draw ink from the nozzles. The wiping operation is executed by the head wiping mechanism 52 to wipe away ink, paper dust, and the like adhered to the nozzle forming surface 32.

As shown in FIG. 3, a print drive controller 61 controls the drive of the carriage motor 42 and the recording head 3 through a driver 62 to thereby perform the desired printing on a recording sheet. A transportation controller 63, in communication with drive controller 61, controls the drive of the recording sheet transportation mechanism 65 such as a transportation motor and the like through a driver 64 in association with the print operation. A head maintenance drive controller 66 controls the drive of the head maintenance process executed by the head wiping mechanism 52 and/or the ink suction mechanism 55 and its associated motor 51 through a driver 67. The head maintenance drive controller 66 provides the drive signals to carry out the head maintenance process based on the results of various measurements made by a maintenance timer 69 that measures the elapsed time since the last head maintenance process was executed by the ink suction mechanism 55 (Tcl), a print amount counter 68 that measures an amount of print (for example, the number of lines printed) since the last head maintenance process was executed by the head wiping mechanism 52 (Pcl), and a timer 70 that measures a non-print period of time (Tnp) during a particular time frame.

When the maintenance timer 69 of this embodiment detects that the elapsed time since the last head maintenance process was executed (Tcl) exceeds a first predetermined period of time T1 (for example, 20 hours), the maintenance timer 69 supplies this information to the head maintenance drive controller 66. When the head maintenance drive controller 66 is notified that Tcl exceeds the first predetermined period of time T1, the head maintenance drive controller 66 executes the head maintenance process.

When the maintenance timer 69 determines that Tcl exceeds a second period of time T2 which is less than T1 (for example, T2=18 hours) but does not exceed T1, the maintenance timer 69 outputs this information to the head maintenance drive controller 66. In this situation, the head maintenance drive controller 66 executes the head maintenance process based on the result of the non-print period of time (Tnp) measured by timer 70. More specifically, when the timer 70 determines that Tnp, a time during which no printing is carried out by the recording head 3, is greater than a third predetermined period of time (a), timer 70 outputs this information to the head maintenance drive controller 66. On receiving this information, the head maintenance drive controller 66 executes the head maintenance process.

The head maintenance process may also be triggered based on the number of lines printed since the last head maintenance process was executed (Pcl). In this case, if the print amount counter 68 detects that Pcl exceeds a first predetermined number of lines L1 (for example, 5000 lines), the counter 68 outputs this information to the head maintenance drive controller 66. On receiving this information, the head maintenance drive controller 66 directs the execution of the head maintenance process.

The counter 68 further determines if Pcl exceeds a second predetermined number of lines L2 which is less than L1 (for example, L2=4800 lines) but does not exceed L1 and outputs this information to the head maintenance drive controller 66. In this situation, the head maintenance drive controller 66 directs the head maintenance process to be performed if the non-print period of time as measured by timer 70 is greater than $\alpha$.

As will be explained in more detail below, when either Tcl exceeds T2 but does not exceed T1 or Pcl exceeds L2 but does not exceed L1, and also Tnp is greater than a, the head maintenance process is executed by one or the other or both the ink suction mechanism 55 and the head wiping mechanism 52. In executing the head maintenance process, the carriage motor 42 is driven to align the recording head 3 with the maintenance unit 5. Then, the head maintenance process is executed by sucking a predetermined amount of ink from the nozzles of the recording head 3 and/or by wiping away the ink and paper dust adhered to the nozzle forming surface 32. When the head maintenance process involves both ink suctioning and head wiping, the ink suctioning process is executed first followed by the head wiping.

At the completion of each head maintenance process the maintenance timer 69 and/or the counter 68 are reset by the head maintenance drive controller 66.

Head Maintenance Process Operation

Figure 4:
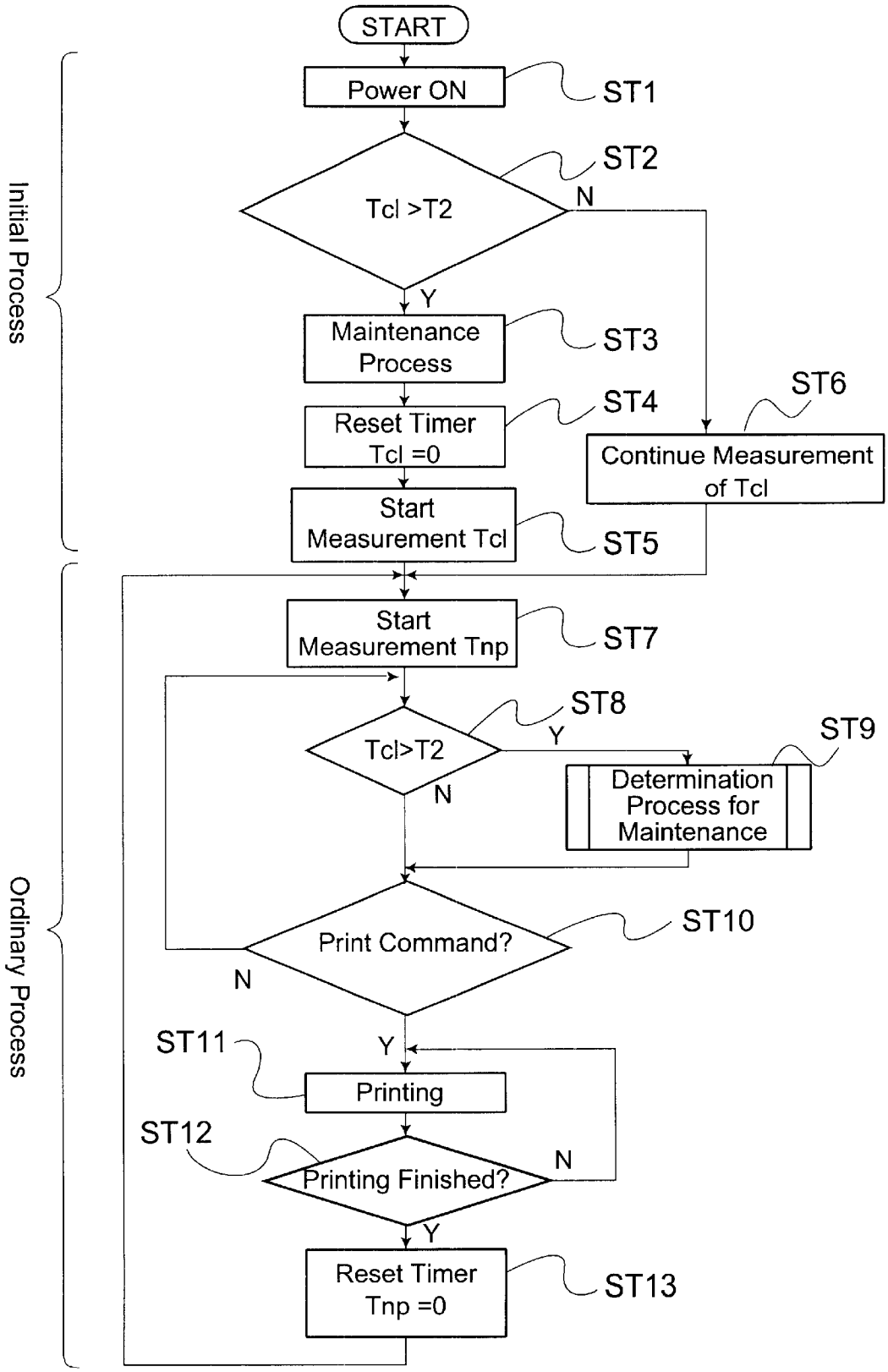
FIG. 4 is a flowchart showing head maintenance processing executed by the ink suction mechanism of the apparatus of FIG. 1.

Next, the head maintenance process, which is executed by the ink suction mechanism 55 and/or the head wiping mechanism 52 of the ink jet recording apparatus 1 of this embodiment, will be described in accordance with the flowcharts of FIG. 4 and FIG. 5.

First, in an initial processing sequence which is carried out when the apparatus 1 is switched on (ST1), it is determined in ST2 if Tcl exceeds T2 (i.e., 18 hours). If so, the head maintenance process is executed by drawing ink from the head 3 as previously described (ST3). Thereafter, the maintenance timer 69 is reset (step ST4) and the count of Tcl is resumed from zero again (step ST5).

Returning to ST2, if it is determined that Tcl does not exceed T2 at the time the recording apparatus 1 is switched on, the count of Tcl is continued without executing the head maintenance process (step ST6).

Next an ordinary processing sequence is executed after the initial processing. First, the counting of the non-print period of time Tnp is started (ST7). Then, in ST8, it is determined whether or not Tcl exceeds the second period of time T2 (i.e., 18 hours). If not, it is next determined if a print command has been issued (ST10). If a print command has been issued while Tcl does not exceed T2, print processing is carried out (ST11). After it is determined in ST12 that printing is completed, the non-print period of time Tnp is reset to zero (ST13) and the counting of Tnp is resumed (ST7).

However, if it is determined in ST8 that Tcl exceeds the second period of time T2 while printing is being performed, the algorithm moves to ST9 containing a subroutine of steps for determining whether or not the head maintenance process is necessary and, if so, when it is to be executed. ST9 is shown in detail in the flowchart of FIG. 5.

Figure 5:
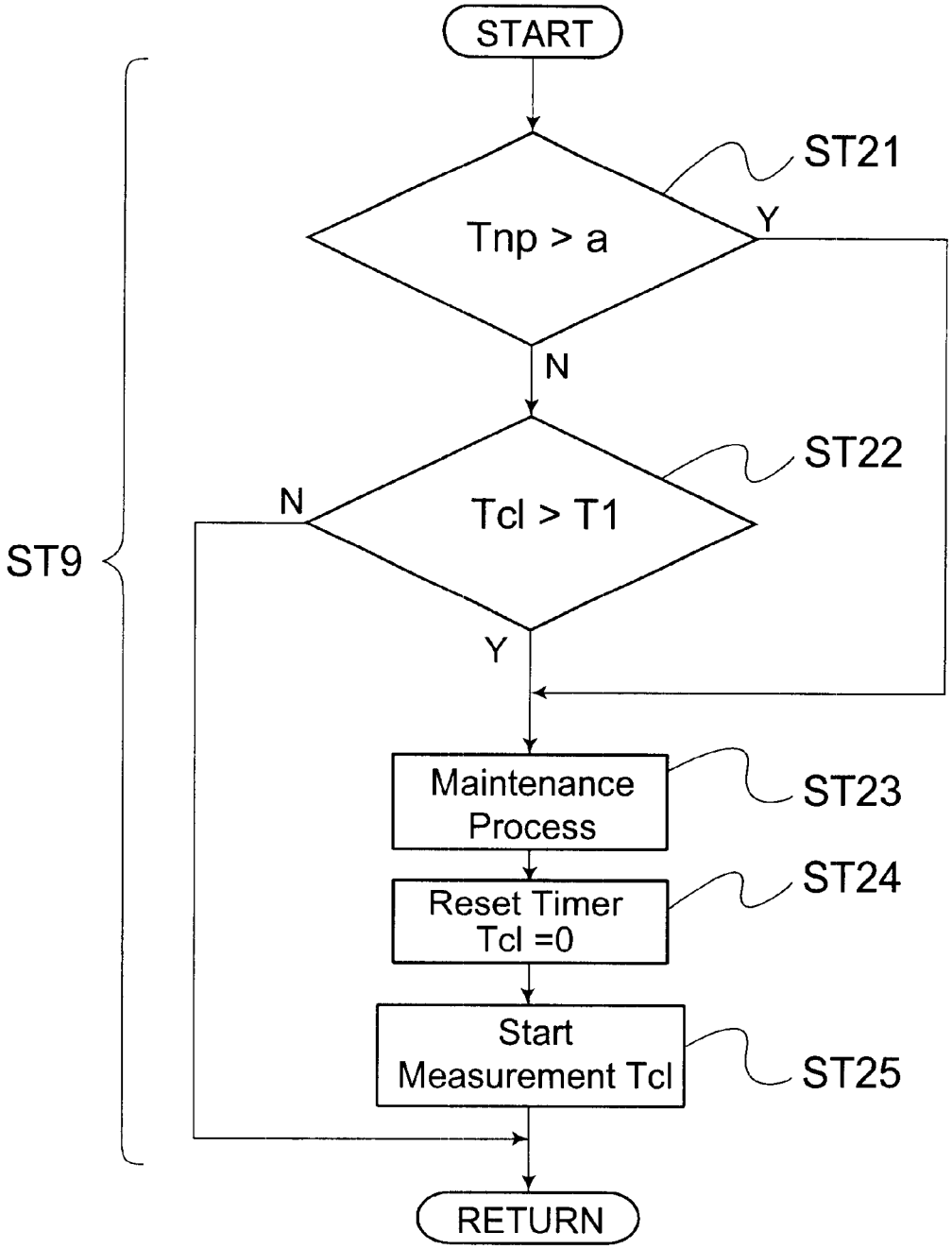
FIG. 5 is a flowchart showing a routine for determining whether or not ink suction processing is necessary and for executing the ink suction processing.

Referring to FIG. 5, first it is determined in ST21 whether or not the non-print period of time Tnp exceeds the third predetermined period of time α (i.e., 5 minutes). If so, the ink suction processing is carried out (ST23). Thus, when no printing occurs for at least some period of time α, it is assumed that a series of successive printing operations are not being performed, and the head maintenance process is carried out. After the head maintenance process is executed, the timer for measuring Tcl is reset to zero (ST24) and the measurement of the Tcl is resumed (ST25).

However, if in ST21 it is determined that the non-print period of time Tnp does not exceed the predetermined period of time α, the routine proceeds to ST22 where it is determined whether or not Tcl exceeds the first period of time T1. If Tcl does not exceed T1, the subroutine is terminated and the algorithm proceeds to ST10 (see FIG. 4). However, if it is determined in ST22 that Tcl exceeds T1, the head maintenance processing (ink suction processing) is immediately executed in ST23 followed by the resetting of the timer measuring Tcl (ST24) and restarting of the Tcl time period (ST25). In other words, when Tcl exceeds T1, the head maintenance process is carried out without fail regardless of whether the non-print period is greater than α. Thus, under this condition, execution of the head maintenance process takes priority over the completion of a series of successive print jobs which are cued up. In this case, the head maintenance process will be performed after the completion of one of the successive print operations but before the next one begins.

As described above, in the ink jet recording apparatus 1 of this embodiment, the printing status is monitored from T2 (i.e., 18 hours) until T1 (i.e., 20 hours) since the last head maintenance process was performed to determine if there is a convenient time to execute another head maintenance process. If no printing activity has occurred for some predetermined period of time α (i.e., 5 minutes), it is assumed that it is a convenient time to perform the next head maintenance process and so it is executed. However, when Tcl exceeds T1 the head maintenance process is executed regardless of the printing status. Therefore, provided that Tcl does not exceed some upper time period T1, the head maintenance process will not be executed between the issuance of a print command and the start of a print operation. Moreover, by preparing for the head maintenance process before it must be performed and monitoring the print status during this preparation period, the head maintenance process can be executed at a time when it is not very likely to cause a delay in the execution of a print operation. Thus, according to this embodiment of the invention, the head maintenance process can be timely executed to maintain the recording head so that high quality printing can be carried out without prolonging a print operation.

In the most preferred embodiment of the invention, a head maintenance process by ink suctioning is executed in combination with a head wiping process. In such an embodiment, ST3 in FIG. 4 and ST23 in FIG. 5 include an ink suction process immediately followed by a head wiping process. Thus, any ink adhered to the nozzle forming surface 32 after the ink suction process is then removed by the wiping. In the combined process any foreign matter may also be removed from the nozzle forming surface 32 along with the additional ink. When ST3 and ST23 include head wiping, ST4 in FIG. 4 and ST24 in FIG. 5 include resetting Pcl in addition to resetting Tcl while ST5 and ST25 also start counting Pcl from zero again.

Another Example of Head Maintenance Processing

The wiping of the nozzle forming surface 32 which is executed by the head wiping mechanism 52 can be also employed as the head maintenance process. In this case, the time at which the head maintenance processing is performed can be determined based on the amount of print generated (i.e., the number of lines printed) by the recording head 3.

When the head maintenance process is carried out based on the number of printed lines, the print amount counter 68 of the drive control system of the ink jet recording apparatus shown in FIG. 3 issues a head maintenance command when the number of lines printed since the last head wiping operation (head maintenance process) Pcl exceeds a first predetermined number of printed lines L1 (for example, 5000 lines). In addition, the counter 68 also determines when Pcl exceeds a second predetermined number of printed lines L2 which is less than L1 (L2=4800 lines, for example).

When it is determined that Pcl reaches L2, the head maintenance drive controller 66 executes the head maintenance process by driving the head wiping mechanism 52 when the non-print period of time Tnp is longer than the third period of time α (for example, 5 minutes).

Figure 6:
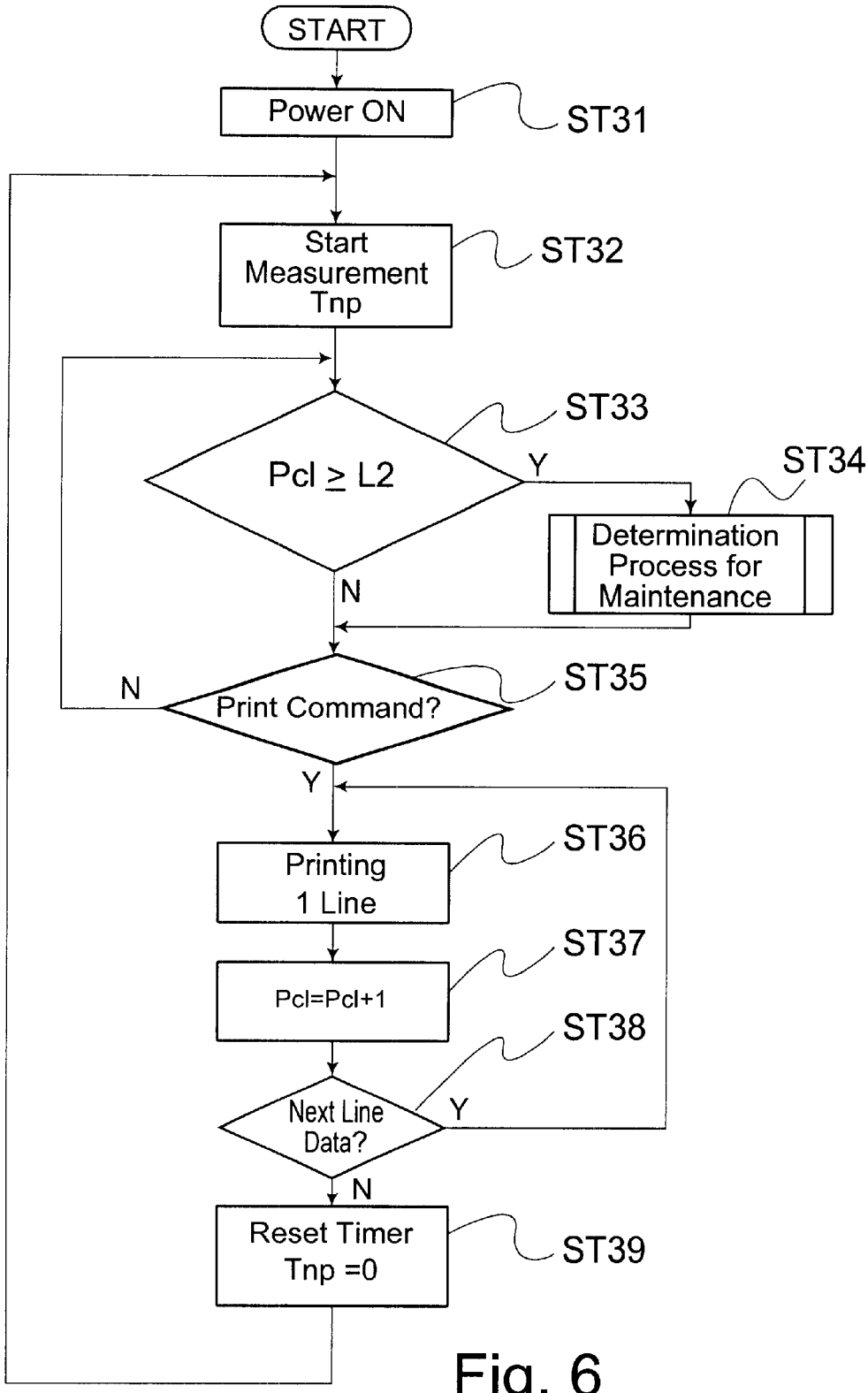
FIG. 6 is a flowchart of the head maintenance processing executed by the ink wiping mechanism of the apparatus of FIG. 1.

An example of control of the head maintenance process executed using the head wiping mechanism 52 will be described with reference to the flowcharts of FIGS. 6 and 7. Referring first to FIG. 6, when the recording apparatus 1 is turned on (ST31), the measurement of the non-print period of time Tnp is started (ST32). Next, it is determined whether or not Pcl is greater than or equal to L2 (i.e., 4800 lines). If not, it is next determined if a print command has been issued (ST35). If not, the algorithm returns to ST33. If a print command has been issued while Pcl is less than L2, printing is carried out line-by-line in ST36 to ST38, with the number of printed lines Pcl being incremented by "1" each time a line is printed. On the completion of the printing, the non-print period of time Tnp is reset to zero (ST39) and the measurement thereof is resumed (ST32).

However, if it is determined in ST33 that Pcl is greater than or equal to L2, the algorithm proceeds to ST34 which is a subroutine of steps for determining whether or not the wiping operation is necessary and, if so, when it is to be carried out. ST34 is shown in detail in the flowchart of FIG. 7.

Figure 7:
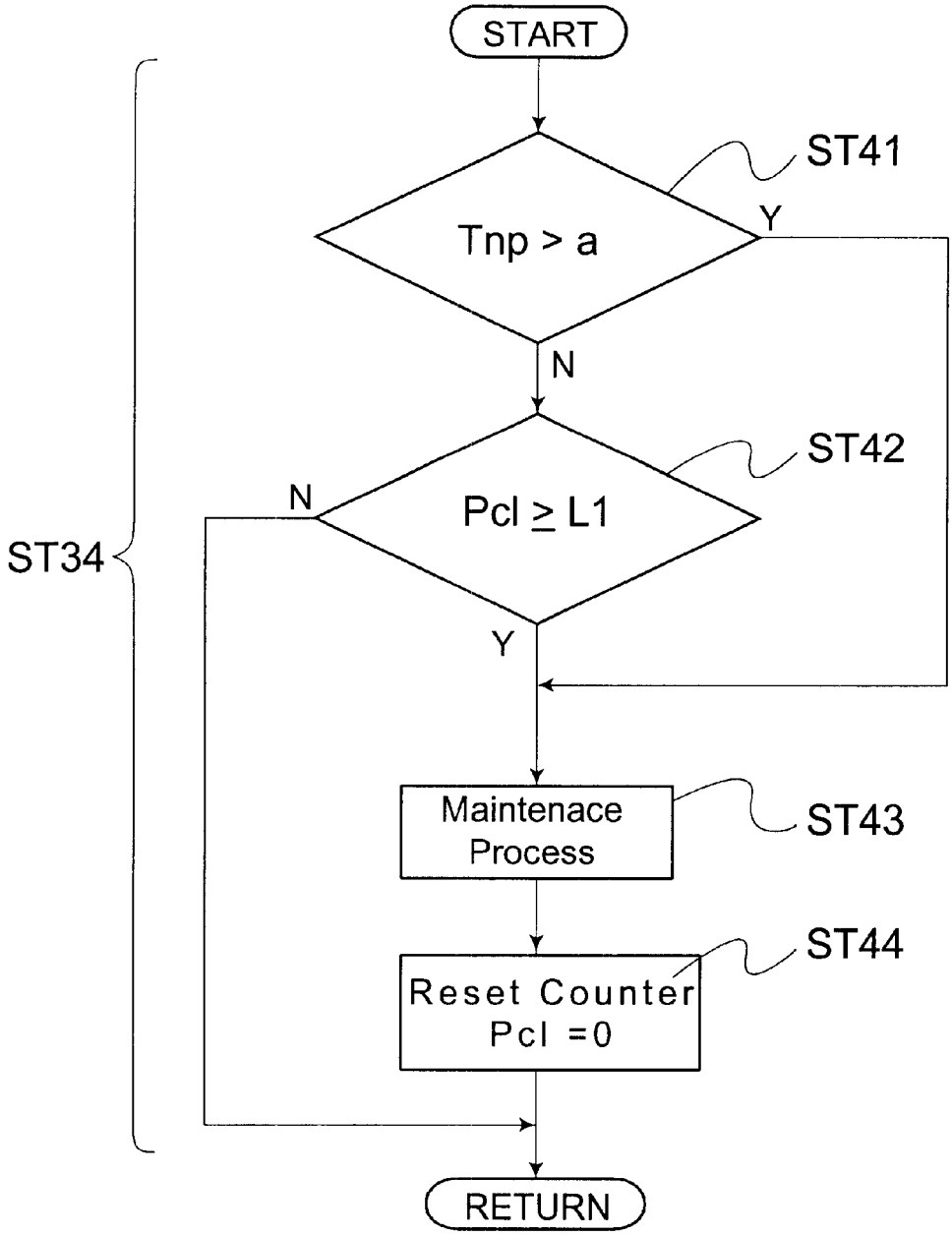
FIG. 7 is a flowchart showing a routine for determining whether or not the wiping of a head shown in FIG. 6 is necessary and for wiping the head.

In the subroutine shown in FIG. 7 first it is determined in ST41 whether or not the non-print period of time Tnp exceeds the third predetermined period of time α (i.e., 5 minutes). If Tnp does not exceed a, it is then determined whether or not Pcl is greater than or equal to L1 (ST42). If not, the subroutine of FIG. 7 terminates and the algorithm proceeds to ST35 (see FIG. 6).

If, however, it is determined in ST41 that Tnp exceeds a, the subroutine goes to ST43 where the head maintenance process is executed. Following the completion of the head maintenance process, the amount of print Pcl is reset to zero (ST44).

Even if Tnp does not exceed the time α, if Pcl exceeds L1, the subroutine goes to step ST43 and immediately executes the head maintenance processing.

Hence, in this embodiment, when Pcl reaches P1, the head maintenance process must be executed and is in fact executed with preference over a print operation. However, to avoid interference with a print operation, an attempt is made to execute the head maintenance process sufficiently before L1 is reached. When the count value is within the interval $L2 \leqq Pcl < L1$, execution of the head maintenance process is not yet as urgent as it is when $Pcl \geqq L1$. Thus, during the interval $L2 \leqq Pcl < L1$, the print status is monitored, and if there is a sufficient period of time during which the printer is not being used, that is, $Tnp > \alpha$, then the head maintenance process is executed so as not to delay a printing operation. Thus, the heading wiping process performed in accordance with the above procedure provides the ink jet recording apparatus with the same advantages as the previously described suction process.

Other Embodiments

In the description of the above embodiments, the head maintenance process is carried out only by the ink suction mechanism 55, only by the head wiping mechanism 52, or by both with the ink suctioning preferably performed first followed by the head wiping. When the head maintenance process is executed by both of these mechanisms, it is possible to determine the time at which the ink suction process is to be carried out based on Tcl and to determine the time at which the head wiping process is to be carried out based on Pcl. It is, of course, possible, depending upon the circumstances, to determine the time at which the ink suction process is to be carried out based on Pcl and to determine the time at which the head wiping process is to be carried out based on Tcl.

Furthermore, the head maintenance process may include additional processing other than the ink suction processing and the head wiping processing.

It should be noted that the values given for the predetermined time periods T1, T2 and a as well as for the predetermined print amounts P1 and P2 are by way of example only. Other values may be used. Moreover, the values should be individually determined for a specific recording apparatus depending on the requirements and usage of the apparatus.

In the above-described embodiments, a single maintenance timer is used to determine whether Tcl exceeds both T1 and T2. However, these measurements may be made by separate timers. Likewise, although a single counter is used to compare Pcl with both L1 and L2 in the illustrated embodiments, these determinations may be made separate counters. Also, the functions of timers 69 and 70 may be combined into a single timer.

As described above, in the ink jet recording apparatus 1 of this embodiment, the printing status is monitored within a certain window of time (T1–T2) or within a certain range of lines printed (L1–L2) since the last head maintenance process was performed to determine a convenient time to execute another head maintenance process. If no printing activity has occurred for some predetermined period of time the head maintenance process is executed. However, T1 and L1 act as an upper limit for executing the head maintenance process regardless of the printing status.

Therefore, subject to these upper limits, the head maintenance process will not be executed between the issuance of a print command and the start of a print operation. Moreover, by preparing for the head maintenance process before it must be performed and monitoring the print status during this preparation period, the head maintenance process can be executed at a time when it is not very likely to cause a delay in the execution of a print operation. Thus, in accordance with the invention, the head maintenance process can be timely executed to maintain the recording head so that high quality printing can be carried out without prolonging a print operation.

While the invention has been described in conjunction with several specific embodiments, many further alternatives, modifications, applications and variations will be evident to those skilled in the art in light of the foregoing description. Thus, the invention described herein is intended to embrace all such alternatives, modifications, applications and variations as may fall within the spirit and scope of the appended claims.

What is claimed is:

1. An ink jet recording apparatus including a recording head having at least one nozzle through which ink droplets are ejected, and a maintenance unit for maintaining the recording head, said ink jet recording apparatus further comprising:

at least one timer that measures an elapsed time since a last maintenance operation was performed by the maintenance unit and compares the elapsed time with a first period of time and a second period of time which is less than the first period of time, wherein the at least one timer also measures a non-print period of time during which no printing operation is performed by the recording head and compares the non-print period of time with a third period of time; and a controller that controls the maintenance unit such that the maintenance unit performs a new maintenance operation when the non-print period of time is greater than the third period of time and the elapsed time is greater than the second period of time but less than the first period of time, and such that the maintenance unit performs a new maintenance operation without referring to the non-print period of time when the elapsed time exceeds the first period of time.

2. An ink jet recording apparatus including a recording head having at least one nozzle through which ink droplets are ejected, and a maintenance unit for maintaining the recording head, said ink jet recording apparatus further comprising:

at least one timer that measures an elapsed time since a last maintenance operation was performed by the maintenance unit and compares the elapsed time with a first period of time and a second period of time which is less than the first period of time, wherein the at least one timer also measures a non-print period of time during which no printing operation is performed by the recording head and compares the non-print period of time with a third period of time;

a controller that controls the maintenance unit such that the maintenance unit performs a new maintenance operation when the non-print period of time is greater than the third period of time and the elapsed time is greater than the second period of time but less than the first period of time, and such that the maintenance unit performs a new maintenance operation without referring to the non-print period of time when the elapsed time exceeds the first period of time; and a counter that counts an amount of print generated by the recording head since the maintenance unit performed the last maintenance operation and compares the amount of print with a first print amount and a second print amount which is less than the first print amount;

wherein the at least one timer measures the non-print period of time; and wherein said maintenance controller controls the maintenance unit such that the maintenance unit performs a new maintenance operation when the non-print period of time is greater than the third period of time and the amount of print is greater than the second print amount but less than the first print amount, and such that the maintenance unit performs a new maintenance operation without referring to the non-print period of time when the amount of print exceeds the first print amount.

3. An ink jet recording apparatus according to claim 1, wherein the maintenance unit includes a pump for sucking ink from each nozzle of the recording head.

4. An ink jet recording apparatus according to claim 1, wherein the maintenance unit includes a wiper for wiping away foreign matter adhered to a nozzle surface on which each nozzle is formed.

5. An ink jet recording apparatus including a recording head having at least one nozzle through which ink droplets are ejected, and a maintenance unit for maintaining the recording head, said ink jet recording apparatus further comprising:

a counter that counts an amount of print generated by the recording head since a last maintenance operation was performed by the maintenance unit and compares the amount of print with a first print amount and a second print amount which is less than the first print amount, a timer that measures a non-print period of time during which no printing operation is performed by the recording head and compares the non-print period of time with a predetermined period of time; and a controller that controls the maintenance unit such that the maintenance unit performs a new maintenance operation when the non-print period of time is greater than the predetermined period of time and the amount of print is greater than the second print amount but less than the first print amount, and such that the maintenance unit performs a new maintenance operation without referring to the non-print period of time when the amount of print exceeds the first print amount.

6. A method for maintaining an ink jet recording apparatus that includes a recording head having at least one nozzle through which ink droplets are ejected, said method comprising the steps of:

measuring an elapsed time since a last maintenance operation was performed on the recording head and comparing the elapsed time with a first period of time and a second period of time which is less than the first period of time;

measuring a non-print period of time during which no printing operation is performed by the recording head, and comparing the non-print period of time with a third period of time;

performing a new maintenance operation on the recording head when the non-print period of time is greater than the third period of time and the elapsed time is greater than the second period of time but less than the first period of time; and performing a new maintenance operation on the recording head without referring to the non-print period of time when the elapsed time exceeds the first period of time.

7. A method for maintaining an ink jet recording apparatus according to claim 6, wherein the maintenance operation includes sucking ink from each nozzle of the recording head.

8. A method for maintaining an ink jet recording apparatus according to claim 6, wherein the maintenance operation includes removing foreign matter adhered to a nozzle surface to which each nozzle of the recording head is formed.

9. A method for maintaining an ink jet recording apparatus that includes a recording head having at least one nozzle through which ink droplets are ejected, said method comprising the steps of:

counting an amount of print generated by the recording head since a last maintenance operation was performed on the recording head and comparing the amount of print with a first print amount and with a second print amount which is less than the first print amount;

measuring a non-print period of time during which no printing operation is performed by the recording head, and comparing the non-print period of time with a predetermined period of time;

performing a new maintenance operation on the recording head when the non-print period of time is greater than the predetermined period of time and the amount of print is greater than the second print amount but less than the first print amount; and performing a new maintenance operation on the recording head without referring to the non-print period of time when the amount of print exceeds the first print amount.

10. A medium readable by a device embodying a program of instructions for execution by said device to perform a method for maintaining an ink jet recording apparatus that includes a recording head having at least one nozzle through which ink droplets are ejected, said method comprising the steps of:

measuring an elapsed time since a last maintenance operation was performed on the recording head and comparing the elapsed time with a first period of time and a second period of time which is less than the first period of time;

measuring a non-print period of time during which no printing operation is performed by the recording head, and comparing the non-print period of time with a third period of time;

performing a new maintenance operation on the recording head when the non-print period of time is greater than the third period of time and the elapsed time is greater than the second period of time but less than the first period of time; and performing a new maintenance operation on the recording head without referring to the non-print period of time when the elapsed time exceeds the first period of time.

11. A medium readable by a device embodying a program of instructions for execution by said device to perform a method for maintaining an ink jet recording apparatus that includes a recording head having at least one nozzle through which ink droplets are ejected, said method comprising the steps of:

counting the amount of print generated by the recording head since a last maintenance operation was performed on the recording head and comparing the amount of print with a first print amount and with a second print amount which is less than the first print amount;

measuring a non-print period of time during which no printing operation is performed by the recording head, and comparing the non-print period of time with a predetermined period of time;

performing a new maintenance operation on the recording head when the non-print period of time is greater than the predetermined period of time and the amount of print is greater than the second print amount but less than the first print amount; and performing a new maintenance operation on the recording head without referring to the non-print period of time when the amount of print exceeds the first print amount.

12. A program of instructions for implementing a method for maintaining an ink jet recording apparatus that includes a recording head having at least one nozzle through which ink droplets are ejected, said method comprising the steps of:

measuring an elapsed time since a last maintenance operation was performed on the recording head and comparing the elapsed time with a first period of time and a second period of time which is less than the first period of time;

measuring a non-print period of time during which no printing operation is performed by the recording head, and comparing the non-print period of time with a third period of time;

performing a new maintenance operation on the recording head when the non-print period of time is greater than the third period of time and the elapsed time is greater than the second period of time but less than the first period of time; and performing a new maintenance operation on the recording head without referring to the non-print period of time when the elapsed time exceeds the first period of time.

13. A program of instructions for implementing a method for maintaining an ink jet recording apparatus that includes a recording head having at least one nozzle through which ink droplets are ejected, said method comprising the steps of:

counting the amount of print generated by the recording head since a last maintenance operation was performed on the recording head and comparing the amount of print with a first print amount and with a second print amount which is less than the first print amount;

measuring a non-print period of time during which no printing operation is performed by the recording head, and comparing the non-print period of time with a predetermined period of time;

performing a new maintenance operation on the recording head when the non-print period of time is greater than the predetermined period of time and the amount of print is greater than the second print amount but less than the first print amount; and performing a new maintenance operation on the recording head without referring to the non-print period of time when the amount of print exceeds the first print amount.

14. An ink jet recording apparatus including a recording head having at least one nozzle through which ink droplets are ejected, and a maintenance unit for maintaining the recording head, said ink jet recording apparatus further comprising:

at least one counting device that counts at least one physical quantity to obtain at least one magnitude indicative of a degree of operativeness of the recording head, and also counts a non-print period of time during which no printing operation is performed by the recording head and compares the non-print period of time with a reference period of time; and a controller that controls the maintenance unit in response to the at least one counting device such that the maintenance unit performs a new maintenance operation:

when the at least one magnitude exceeds a second value but does not exceed the first value and the non-print period of time is greater than the reference period of time.

15. An ink jet recording apparatus according to claim 14, wherein the at least one counting device comprises at least one timer that counts an elapsed time since a last maintenance operation was performed by the maintenance unit and compares the elapsed time with a first period of time and a second period of time which is less than the first period of time, and also counts the non-print period of time.

16. An ink jet recording apparatus according to claim 15, wherein the maintenance unit performs a new maintenance operation when either of the following conditions is met:

(a) the elapsed time exceeds the first period of time; or (b) the elapsed time exceeds the second period of time but does not exceed the first period of time and the non-print period of time is greater than the reference period of time.

17. An ink jet recording apparatus according to claim 16, wherein the maintenance unit includes a pump for sucking ink from each nozzle of the recording head.

18. An ink jet recording apparatus including a recording head having at least one nozzle through which ink droplets are ejected, and a maintenance unit for maintaining the recording head, said ink jet recording apparatus further comprising:

at least one counting device that counts at least one physical quantity to obtain at least one magnitude indicative of a degree of operativeness of the recording head, and also counts a non-print period of time during which no printing operation is performed by the recording head and compares the non-print period of time with a reference period of time; and a controller that controls the maintenance unit in response to the at least one counting device such that the maintenance unit performs a new maintenance operation when either of the following conditions is met:

(a) the at least one magnitude exceeds a first value; or (b) the at least one magnitude exceeds a second value but does not exceed the first value and the non-print period of time is greater than the reference period of time, wherein the counting device comprises a counter that counts an amount of print generated by the recording head since a last maintenance operation was performed by the maintenance unit and compares the amount of print with a first print amount and a second print amount which is less than the first print amount, and a timer that counts the non-print period of time.

19. An ink jet recording apparatus according to claim 18, wherein the maintenance unit performs a new maintenance operation when either of the following conditions is met:

(a) the amount of print exceeds the first print amount; or (b) the amount of print exceeds the second print amount but does not exceed the first print amount and the non-print period of time is greater than the reference period of time.

20. An ink jet recording apparatus according to claim 19, wherein the maintenance unit includes a wiper for wiping away foreign matter adhered to a nozzle surface on which each nozzle is formed.

21. A method for maintaining an ink jet recording apparatus that includes a recording head having at least one nozzle through which ink droplets are ejected, said method comprising the steps of:

counting at least one physical quantity to obtain at least one magnitude indicative of a degree of operativeness of the recording head;

counting a non-print period of time during which no printing operation is performed by the recording head and comparing the non-print period of time with a reference period of time;

performing a new maintenance operation on the recording head:

when the at least one magnitude exceeds a second value but does not exceed the first value and the non-print period of time is greater than the reference period of time.

22. A method for maintaining an ink jet recording apparatus according to claim 21, wherein the step of counting at least one physical quantity comprises counting an elapsed time since a last maintenance operation was performed and comparing the elapsed time with a first period of time and a second period of time which is less than the first period of time, and also counting the non-print period of time.

23. A method for maintaining an ink jet recording apparatus according to claim 22, wherein the performing step comprises performing a new maintenance operation when either of the following conditions is met:

(a) the elapsed time exceeds the first period of time; or (b) the elapsed time exceeds the second period of time but does not exceed the first period of time and the non-print period of time is greater than the reference period of time.

24. A method for maintaining an ink jet recording apparatus according to claim 23, wherein performing a new maintenance operation includes sucking ink from each nozzle of the recording head.

25. A method for maintaining an ink jet recording apparatus that includes a recording head having at least one nozzle through which ink droplets are ejected, said method comprising the steps of:

counting at least one physical quantity to obtain at least one magnitude indicative of a degree of operativeness of the recording head;

counting a non-print period of time during which no printing operation is performed by the recording head and comparing the non-print period of time with a reference period of time; performing a new maintenance operation on the recording head when either of the following conditions is met:

(a) the at least one magnitude exceeds a first value; or (b) the at least one magnitude exceeds a second value but does not exceed the first value and the non-print period of time is greater than the reference period of time, wherein the step of counting at least one physical quantity comprises counting an amount of print generated by the recording head since a last maintenance operation was performed and comparing the amount of print with a first print amount and a second print amount which is less than the first print amount, and also counting the non-print period of time.

26. A method for maintaining an ink jet recording apparatus according to claim 25, wherein the performing step comprises performing a new maintenance operation when either of the following conditions is met:

(a) the amount of print exceeds the first print amount; or (b) the amount of print exceeds the second print amount but does not exceed the first print amount and the non-print period of time is greater than the reference period of time.

27. A method for maintaining an ink jet recording apparatus according to claim 26, wherein performing a new maintenance operation includes wiping away foreign matter adhered to a nozzle surface on which each nozzle is formed.

* * * * *